United States Patent [19]

Taylor et al.

[11] Patent Number: 4,968,072

[45] Date of Patent: Nov. 6, 1990

[54] BOLT LOCK

[76] Inventors: Harry L. Taylor; Charles O. Ehret, both of 54 Buckley Meadows Dr., St. Louis, Mo. 63125

[21] Appl. No.: 393,238

[22] Filed: Aug. 14, 1989

[51] Int. Cl.[5] ..... E05C 1/10

[52] U.S. Cl. ..... 292/178; 292/DIG. 46; 292/179; 292/180

[58] Field of Search ..... 292/152, 327, 175, 177, 292/178, 179, 180, 181, 182, 60, 103, 147, 204, 306, DIG. 46, DIG. 47, 58, 59, 61; 248/408

[56] References Cited

U.S. PATENT DOCUMENTS

| | | | |
|---|---|---|---|
| 1,198,509 | 9/1916 | Anderson | 292/179 |
| 1,815,422 | 7/1931 | Songey | 292/60 |
| 1,903,782 | 4/1933 | Eyring . | |
| 2,210,080 | 8/1940 | Hover et al. | 292/180 |
| 2,657,086 | 10/1953 | Sweet | 292/175 |
| 3,082,617 | 3/1963 | Kerman | 292/179 |
| 3,288,510 | 11/1966 | Gough et al. | 292/251 |
| 3,397,000 | 8/1968 | Nakanishi | 292/61 |
| 3,626,507 | 12/1971 | Hawkins | 292/175 |
| 3,751,087 | 8/1973 | Hawkins | 292/170 |
| 3,768,847 | 10/1973 | Bulk, Jr. et al. | 292/179 |
| 3,847,422 | 11/1974 | Gulistan | 292/60 |
| 3,956,911 | 5/1976 | Corboud | 292/DIG. 46 |
| 3,984,136 | 10/1976 | Bills | 292/DIG. 46 |
| 4,113,221 | 9/1978 | Wehner | 292/61 |
| 4,190,272 | 2/1980 | Beard | 292/DIG. 46 |
| 4,293,154 | 10/1981 | Cassells | 292/DIG. 47 |
| 4,565,078 | 1/1986 | Solomon | 292/179 |
| 4,699,406 | 10/1987 | Swanson, Jr. | 292/DIG. 47 |

FOREIGN PATENT DOCUMENTS

| | | | |
|---|---|---|---|
| 2352935 | 5/1976 | France | 292/DIG. 46 |
| 618300 | 2/1949 | United Kingdom | 292/152 |
| 1330696 | 9/1973 | United Kingdom | 292/179 |

*Primary Examiner*—Eric K. Nicholson

*Attorney, Agent, or Firm*—Senniger, Powers, Leavitt & Roedel

[57] ABSTRACT

A bolt lock for locking a sliding member having an aperture therein to a stationary member having an aperture therein includes a body adapted for mounting to the sliding member and the body including a guide in registry with the aperture of the sliding member. The bolt lock also includes a bolt having one end inserted through the guide for movement between a locked position of engagement in the aperture in the stationary member and an unlocked position of disengagement with the aperture in the stationary member, and a handle connected to the other end of the bolt with the handle engaging the body to lock the bolt in the locked position.

14 Claims, 1 Drawing Sheet

FIG. 1.
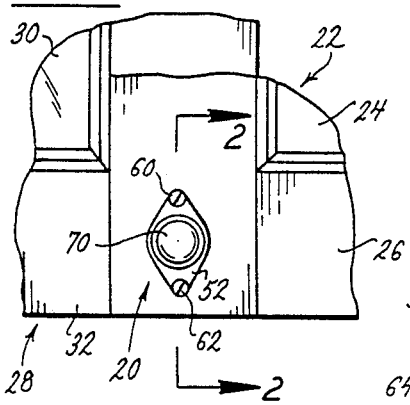
FIG. 5.
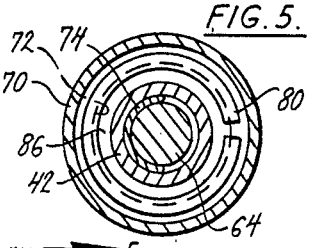
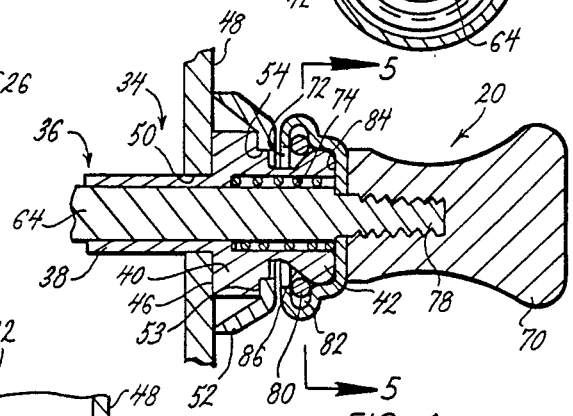
FIG. 4.
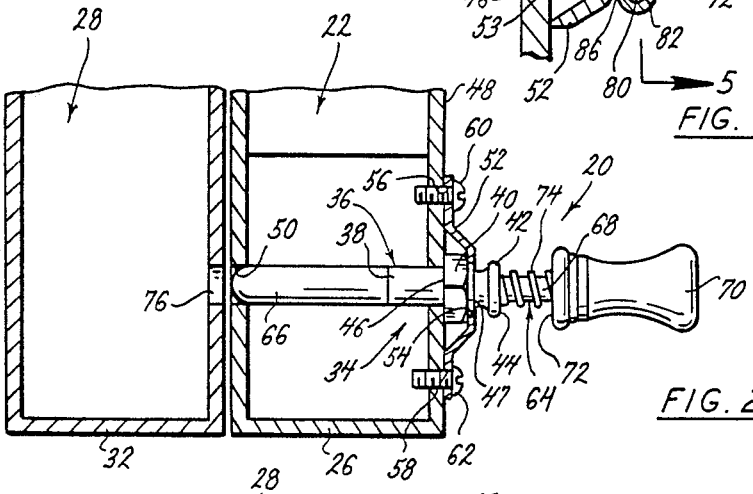
FIG. 2.
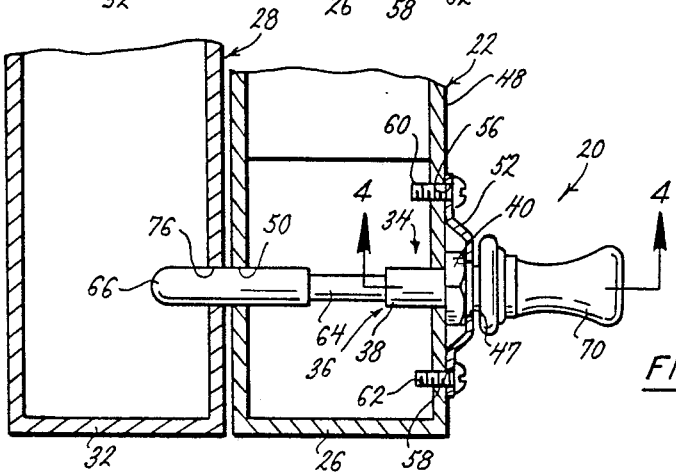
FIG. 3.

BOLT LOCK

BACKGROUND OF THE INVENTION

The present invention relates to a bolt lock for locking windows and sliding doors and in particular to a bolt lock having a bolt which cannot be shaken out of its locked position.

Devices for locking windows and sliding doors are well known in the prior art. Examples of some prior art locks are disclosed in U.S. Pat. Nos. 3,288,510; 3,626,507; 3,751,087; and 4,699,406. Typically, such locks include a mounting element secured to the sliding member with the mounting element having a bolt which is moved between an unlocked position and a locked position. Many of these locks were of complicated construction and thus were expensive to manufacture. Additionally, some of these locks were difficult to manipulate between the locked and unlocked positions.

SUMMARY OF THE INVENTION

Among the objects of the present invention is the provision of a bolt lock which is of simple construction for low cost and highly reliable operation; the provision of such a bolt lock which can be quickly and conveniently installed in existing or new windows or sliding doors; and the provision of such a bolt lock which positively and firmly locks in place.

The bolt lock of the present invention is adapted for use on sliding doors or windows of the types having a sliding member and a stationary member or two sliding members. Generally, the bolt lock includes a body adapted for mounting to the sliding member with the body having a guide. A bolt is inserted through the guide for movement between a locked position of engagement in an aperture in the stationary member and an unlocked position of disengagement with the aperture in the stationary member. The lock also includes means, connected between the bolt and the body, for selectively locking the bolt in the locked position.

In another form of the present invention, a bolt lock apparatus includes a mounting body adapted to be inserted into an aperture formed in a sliding member, the body including a guide and a projection extending out of the body, a bolt having one end inserted through the guide for movement between a locked position of engagement in an aperture in a stationary member and an unlocked position of disengagement with the aperture in the stationary member, and means connected to the other end of the bolt for engaging the projection for locking the bolt in the locked position.

Other objects and features will be in part apparent and in part pointed out hereinafter.

BRIEF DESCRIPTION OF THE DRAWINGS

FIG 1 is a front plan view of a bolt lock of the present invention installed on a sliding glass door;

FIG. 2 is an enlarged cross-sectional view of the bolt lock taken along the line 2—2 of FIG. 1;

FIG. 3 is a cross-sectional view of the bolt lock of FIG. 2 in a locked position;

FIG. 4 is an enlarged cross-sectional view of the bolt lock taken along the line 4—4 of FIG. 3; and FIG. 5 is a cross-sectional view of the bolt lock taken along the line 5—5 of FIG. 4.

Corresponding reference characters indicate corresponding parts throughout the several views of the drawings.

DETAILED DESCRIPTION OF THE PREFERRED EMBODIMENT

A bolt lock of the present invention is shown generally as 20 in the drawings. The lock 20 is illustrated in FIG. 1 installed in a sliding glass door 22. The door 22 includes a pane of glass 24 framed within a sash 26 mounted for slidable movement longitudinally along a track (not shown) in a conventional manner. The door 22 also includes a stationary member 28 having a pane of glass 30 framed within a sash 32.

FIG. 2 illustrates the components of the bolt lock 20. The bolt lock 20 comprises a mounting body 34 which includes a guide or hollow cylinder 36 having a front end 38 extending into the sash 26, an intermediate portion 40, and a collar 42 extending from a back end 44 of the body 34 away from the sash 26. The mounting body 34 is adapted for mounting to the sash 26 of the sliding door 22. A first side 46 of portion 40 is flush against a front side 48 of the door 22. The front end 38 is placed in a hole 50 which has been drilled through the sash 26. The hollow cylinder 36 is in registry with the hole 50. A mounting plate 52 has a central hole 54 and a pair of holes 56 and 58 on either side of the central hole 54. The holes 56 and 58 receive fastening means, such as self-tapping screws 60 and 62, to secure the body 34 to the front side 48 of the door 22. The collar 42 projects out form the central hole 54. A second side 47 of the portion 40 is positioned adjacent to an inner side 53 of the mounting plate 52.

A bolt 64 is inserted through the hollow cylinder 36 of the mounting body 34. The bolt 64 has a front end 66 and a back end 68. The back end 68 of the bolt 64 has a reduced diameter from that of the front end 66. The diameter of the back end 68 is slightly less than the diameter of the hollow cylinder 36. The diameter of the front end 66 is substantially equal to the diameter of the front end 38 of the mounting body 34. The back end 68 includes a handle 70 having an open end 72 in which an end of a spring 74 is inserted. The other end of the spring 74 is inserted into the hollow cylinder 36.

The lock bolt 20 is shown in an unlocked position in FIG. 2. The spring 74 biases the handle 70 and the bolt 64 in the unlocked position and the front end 66 of the bolt 64 is within the sash 26. The front end 66 of the bolt 64 contacts the front end 38 which stops the bolt 64. The front end 66 contacting the front end 38 prevents the bolt 64 from being removed from the body 34 when the bolt 64 is in the unlocked position. The sliding door 22 is free to move in the track relative to the stationary member 28 when the bolt 64 is in the unlocked position.

The bolt lock 20 is shown in a locked position in FIG. 3. The handle 70 has been pushed against the bias of spring 74 to move the front end 66 of the bolt 64 away from the front end 38 of the mounting body 34. The front end 66 of the bolt 64 extends into a hole 76 which has been drilled into the sash 32 of the stationary member 28. with the bolt 64 extending into the hole 76, the sliding door 22 is locked in place. The open end 72 of handle 70 engages the collar 42 to lock the bolt 64 in place. The front end 66 of the bolt 64 is retracted by disengaging the handle 70 from the collar 42.

FIG. 4 shows a cross-sectional view of the bolt lock 20 in the locked position. The handle 70 is screwed on to a threaded end 78 of the bolt 64. The open end 72 of the handle 70 includes a C-shaped spring clip 80 in a groove 82. When the handle 70 is pushed against the bias of spring 74 the collar 42 enters into the open end 72. The collar 42 comes into contact with the clip 80 which spreads the clip 80 apart. Once the collar 42 passes through the clip 80, the clip 80 snaps back into place. The collar 42 is in contact with a back end 84 of the handle 70. The clip 80 engages a tapered portion 86 of the collar 42 and the lock bolt 20 is retained in the extended or locked position. With the clip 80 engaging the tapered portion 84 the bolt lock 20 is prevented from being shaken out of the locked position. To retract or unlock the bolt lock 20, the handle 70 is pulled with sufficient force to spread the clip 80 apart to force it over the collar 42. Once this occurs the spring 74 will bias the handle 70 and the bolt 68 into the unlocked position.

A cross-sectional view of the handle engaging the collar 44 is shown in FIG. 5. The clip 80 has returned to its normal position and is in contact with the tapered portion 86 of the collar 42.

Although shown installed on a sliding glass door, the bolt lock 20 may also be installed on windows such as vertically double hung windows. Preferably the bolt lock 20 and all of its components are fabricated of steel. The bolt lock 20 can be made in various sizes with various length bolts depending on the application.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bolt lock for locking a sliding member having an aperture therein to a stationary member having an aperture therein, the bolt lock comprising:

a body adapted for mounting to the sliding member, the body including a guide in registry with the aperture of the sliding member;

a bolt, having a front end inserted through the guide of the body for movement between a locked position of engagement in the aperture in the stationary member and an unlocked position of disengagement with the aperture in the stationary member, the bolt including a back end which extends out of the body;

means connected between the back end of the bolt and the body for selectively locking the back end of the bolt to the body for locking the bolt in the locked position, the selective locking means comprising a handle connected to the back end of the bolt, the handle including an open end having a groove and a C-shaped spring clip in the groove, the body including a collar projecting from the body toward the handle, the collar having a tapered portion, the spring clip engaging the tapered portion when the bolt is in the locked position; and biasing means between the outside of the body and the locking means for biasing the bolt toward the unlocked position.

2. The bolt lock of claim 1 wherein the front end has a first diameter, the back end has a second diameter, the first diameter being greater than the second diameter.

3. The bolt lock of claim 2 wherein the body has a front end having a third diameter being substantially equal to the first diameter, and the front end of the bolt contacts the front end of the body when the bolt is in the unlocked position to prevent the bolt from being removed from the body.

4. The bolt lock of claim 1 wherein the guide is a hollow cylinder.

5. A bolt lock apparatus for use with a sliding door having a sliding member having an aperture therein and a stationary member having an aperture therein, the apparatus comprising:

a mounting body adapted to be inserted into the aperture formed in the sliding member, the body including a guide in registry with the aperture of the sliding member and a collar extending out of the body;

a bolt having one end inserted through the guide for movement between a locked position of engagement in the aperture in the stationary member and an unlocked position of disengagement with the aperture in the stationary member;

means for biasing the bolt to the unlocked position;

means connected to the other end of the bolt for engaging the collar which extends out of the body for locking the bolt in the locked position, the engaging means comprising a handle connected to said other end of the bolt, the handle including an open end having a groove and a C-shaped spring clip in the groove.

6. The apparatus of claim 5 wherein the collar has a tapered portion and the spring clip engages the tapered portion when the bolt is in the locked position.

7. The apparatus of claim 6 wherein the end of the bolt inserted into the aperture in the stationary member has a first diameter, and the other end of the bolt has a second diameter, the first diameter being greater than the second diameter.

8. The apparatus of claim 7 wherein the body has a front end having third diameter being substantially equal to the first diameter, and the end of the bolt inserted into the aperture in the stationary member contacts the front end of the body when the bolt is in the unlocked position to prevent the bolt from being removed from the body.

9. The apparatus of claim 5 wherein the guide is a hollow cylinder.

10. A bolt lock for locking a sliding member to a stationary member, the bolt comprising:

a mounting body adapted to be inserted into an aperture formed in the sliding member, the body including a front end extending into the sliding member, and intermediate portion, and a collar projecting from the back end of the body away from the aperture of the sliding member, the body further including a guide in registry with the aperture of the sliding member;

a bolt having a front end and a back end, the front end inserted through the guide for movement between a locked position of engagement in an aperture in the stationary member and an unlocked position of disengagement with the aperture in the stationary member; and means connected to the back end of the bolt for engaging the collar for locking the bolt in the locked position, the engaging means comprising a handle connected to the back end of the bolt, the handle including an open end having a groove and a C-shaped spring clamp in the groove.

11. The bolt lock of claim 10 wherein the collar has a tapered portion and the spring clip engages the tapered portion when the bolt is in the locked position.

12. The bolt lock of claim 11 wherein the front end of the bolt has a first diameter and the back end of the bolt has a second diameter, the first diameter being greater than the second diameter.

13. The bolt lock of claim 12 wherein the front end of the body has a third diameter being substantially equal to the first diameter, and the front end of the bolt contacts the front end of the body when the bolt is in the unlocked position to prevent the bolt from being removed from the body.

14. The bolt lock of claim 10 further comprising biasing means between the body and the engaging means for biasing the bolt in forwards the unlocked position.

* * * * *

UNITED STATES PATENT AND TRADEMARK OFFICE

CERTIFICATE OF CORRECTION

PATENT NO. : 4,968,072

DATED : November 6, 1990

INVENTOR(S) : Harry L. Taylor and Charles O. Ehret

It is certified that error appears in the above-identified patent and that said Letters Patent is hereby corrected as shown below:

Column 3, claim 2, line 67, "diameter, the back end", should read ---diameter, and the back end---.

Column 6, claim 14, line 9, "in forwards the unlocked position", should read ---towards the unlocked position---.

Signed and Sealed this

Fourth Day of August, 1992

*Attest:*

DOUGLAS B. COMER

*Attesting Officer*

*Acting Commissioner of Patents and Trademarks*